US012486639B2

(12) United States Patent
Hagiwara

(10) Patent No.: US 12,486,639 B2
(45) Date of Patent: Dec. 2, 2025

(54) WORK VEHICLE AND CONTROL METHOD

(71) Applicant: KOMATSU LTD., Tokyo (JP)

(72) Inventor: Hirohito Hagiwara, Tokyo (JP)

(73) Assignee: KOMATSU LTD., Tokyo (JP)

( * ) Notice: Subject to any disclaimer, the term of this patent is extended or adjusted under 35 U.S.C. 154(b) by 699 days.

(21) Appl. No.: 17/797,789

(22) PCT Filed: Dec. 24, 2020

(86) PCT No.: PCT/JP2020/048434

§ 371 (c)(1),
(2) Date: Aug. 5, 2022

(87) PCT Pub. No.: WO2021/186834

PCT Pub. Date: Sep. 23, 2021

(65) Prior Publication Data

US 2023/0050500 A1 Feb. 16, 2023

(30) Foreign Application Priority Data

Mar. 17, 2020 (JP) ..... 2020-046753

(51) Int. Cl.
*E02F 3/84* (2006.01)

(52) U.S. Cl.
CPC ..... *E02F 3/841* (2013.01); *E02F 3/844* (2013.01)

(58) Field of Classification Search
CPC ... E02F 3/84; E02F 3/841; E02F 3/844; E02F 3/845; E02F 3/847
See application file for complete search history.

(56) References Cited

U.S. PATENT DOCUMENTS

| | | | | |
|---|---|---|---|---|
| 3,899,028 | A | 8/1975 | Morris et al. | |
| 4,282,933 | A * | 8/1981 | Suganami | E02F 9/2029 172/7 |
| 5,107,932 | A * | 4/1992 | Zachman | E02F 3/845 172/1 |
| 6,028,524 | A | 2/2000 | Hartman et al. | |
| 2014/0326471 | A1 | 11/2014 | Zhu et al. | |
| 2014/0343800 | A1* | 11/2014 | Nelson | E02F 3/845 701/49 |
| 2015/0259883 | A1 | 9/2015 | Sharma et al. | |
| 2016/0230366 | A1* | 8/2016 | Hendron | E02F 3/7631 |
| 2016/0230367 | A1* | 8/2016 | Hendron | E02F 9/262 |
| 2018/0038082 | A1* | 2/2018 | Hashimoto | E02F 3/7609 |
| 2018/0216316 | A1* | 8/2018 | Benson | E02F 9/265 |
| 2020/0299934 | A1* | 9/2020 | Ono | E02F 3/7654 |
| 2021/0340735 | A1* | 11/2021 | Veasy | E02F 3/7631 |

FOREIGN PATENT DOCUMENTS

| | | | |
|---|---|---|---|
| JP | S54-112503 | A | 9/1979 |
| JP | S57-178037 | A | 11/1982 |
| JP | S59-102023 | A | 6/1984 |
| JP | H04-319129 | A | 11/1992 |
| JP | H06-057782 | A | 3/1994 |
| JP | H07-180176 | A | 7/1995 |
| JP | 2018-021348 | A | 2/2018 |

* cited by examiner

*Primary Examiner* — Jamie L McGowan
(74) *Attorney, Agent, or Firm* — Faegre Drinker Biddle & Reath LLP

(57) ABSTRACT

A work vehicle includes a vehicular body and a work implement including a blade. The vehicular body includes a controller that controls an operation of the work implement and an acceleration sensor. The controller controls a blade propulsive angle θ of the blade based on an output from the acceleration sensor.

14 Claims, 12 Drawing Sheets

WORK VEHICLE AND CONTROL METHOD

TECHNICAL FIELD

The present disclosure relates to a work vehicle and a method of controlling a work vehicle.

BACKGROUND ART

As shown in Japanese Patent Laying-Open No. 59-102023 (PTL 1), a work vehicle including such a work implement as a blade has conventionally been known. An operator of the work vehicle adjusts a direction of travel of the work vehicle by operating a steering wheel in accordance with a current condition of a road surface at a worksite.

When the worksite is a curve, the operator should operate the steering wheel and the work implement in a combined manner, in accordance with a curvature of the curve. Such combined operations are very sophisticated and delicate.

CITATION LIST

Patent Literature

PTL 1: Japanese Patent Laying-Open No. 59-102023

SUMMARY OF INVENTION

Technical Problem

For example, by applying to the work vehicle, a technique to change a blade propulsive angle to follow change in steering angle based on an operation onto the steering wheel, burdens in the operation imposed on an operator may be lessened.

Depending on the condition of the road surface or the like, however, a coefficient of kinetic friction of wheels of the work vehicle is varied. For example, in a case of a motor grader, works may be done with front wheels leaning. Therefore, an accurate direction of travel of the work vehicle has not conventionally been known. Accordingly, it is difficult to have the blade propulsive angle accurately follow change in direction of travel of the work vehicle.

The present disclosure was made in view of problems above, and an object thereof is to provide a work vehicle that allows a blade propulsive angle to accurately follow change in direction of travel of the work vehicle and a method of controlling the work vehicle.

Solution to Problem

According to one aspect of the present disclosure, a work vehicle includes a vehicular body and a work implement including a blade. The vehicular body includes a controller that controls an operation of the work implement and an acceleration sensor. The controller controls a blade propulsive angle of the blade based on an output from the acceleration sensor.

According to another aspect of the present disclosure, a work vehicle includes a swing circle, a blade supported on the swing circle, a front frame, a draw bar attached to the front frame to fluctuate, the swing circle being attached to the draw bar, an acceleration sensor provided in the draw bar, and a controller that controls a blade propulsive angle of the blade by causing the swing circle to rotate based on an output from the acceleration sensor.

According to yet another aspect of the present disclosure, a method of controlling a work vehicle is provided. The work vehicle includes a vehicular body and a work implement including a blade. The vehicular body includes a controller that controls an operation of the work implement and an acceleration sensor. The method includes receiving, by the controller, a signal provided from the acceleration sensor and controlling, by the controller, a blade propulsive angle of the blade based on the signal.

According to still another aspect of the present disclosure, a method of controlling a work vehicle is provided. The work vehicle includes a swing circle, a blade supported on the swing circle, a front frame, a draw bar attached to the front frame to fluctuate, the swing circle being attached to the draw bar, an acceleration sensor provided in the draw bar, and a controller. The method includes receiving, by the controller, a signal provided from the acceleration sensor and controlling, by the controller, a blade propulsive angle of the blade by causing the swing circle to rotate.

Advantageous Effects of Invention

According to the present disclosure, a blade propulsive angle can accurately follow change in direction of travel of a work vehicle.

DESCRIPTION OF EMBODIMENTS

Figure 1:
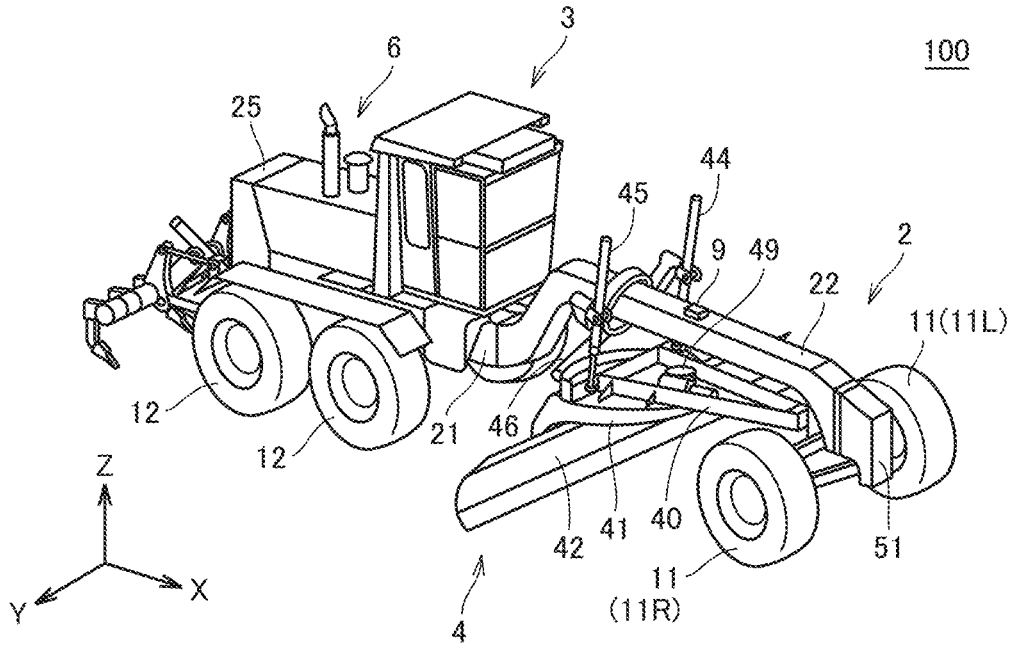
FIG. 1 is a perspective view schematically showing a construction of a motor grader.

An embodiment will be described below with reference to the drawings. In the description below, the same elements have the same reference characters allotted and their labels and functions are also the same. Therefore, detailed description thereof will not be repeated.

First Embodiment

Figure 2:
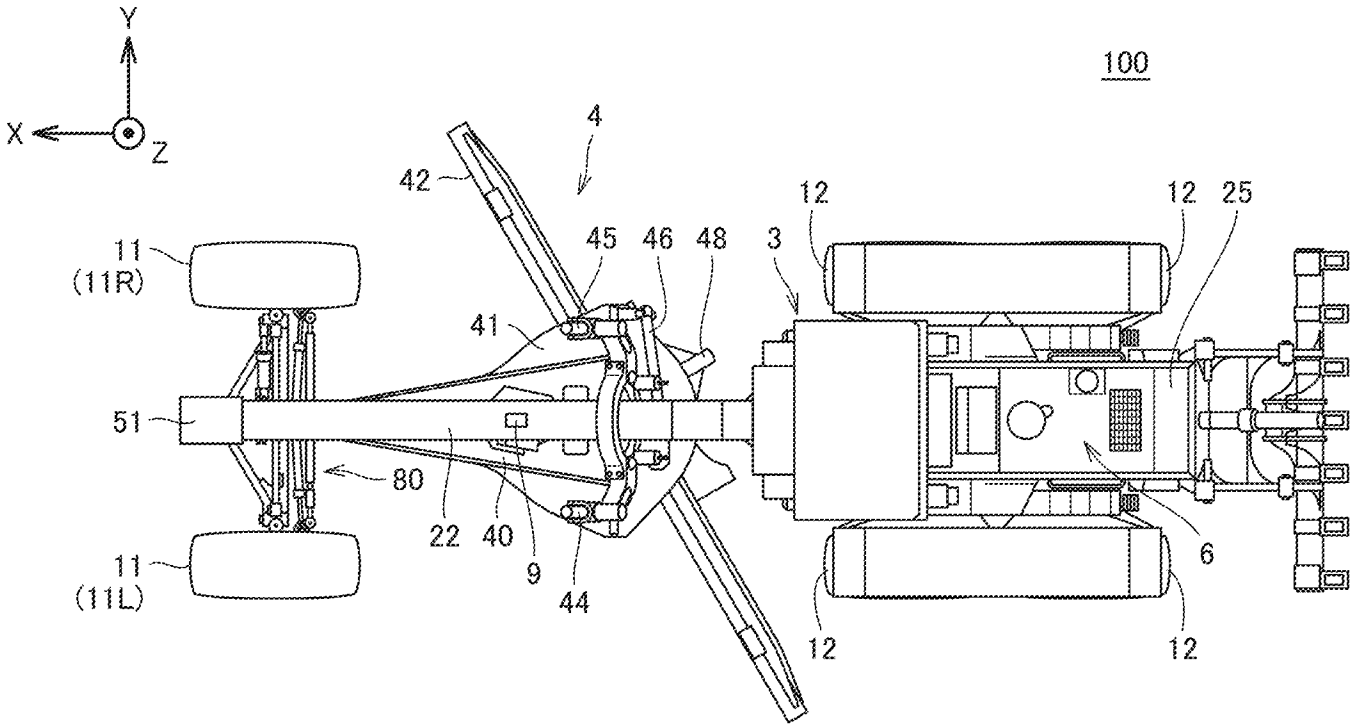
FIG. 2 is a plan view of the motor grader.

A motor grader will be described by way of example of a work vehicle. FIG. 1 is a perspective view schematically showing a construction of a motor grader 100 based on an embodiment. FIG. 2 is a plan view of motor grader 100 shown in FIG. 1.

As shown in FIGS. 1 and 2, motor grader 100 based on the embodiment is constituted of a vehicular body 2 and a work implement 4. Vehicular body 2 mainly includes a front wheel 11 which is a running wheel, a rear wheel 12 which is a running wheel, a rear frame 21, a front frame 22, and a cab 3. Front wheel 11 includes one wheel on each of left and right sides and includes a right front wheel 11R and a left front wheel 11L. Though the figure shows running wheels including two front wheels 11, one on each side, and four rear wheels 12, two on each side, the number and arrangement of front wheels and rear wheels are not limited as such.

Motor grader 100 includes components such as an engine arranged in an engine compartment 6. Work implement 4 includes a blade 42. Motor grader 100 can do such works as land-grading works, snow removal works, light cutting, and mixing of materials with blade 42.

In the description of the drawings below, a direction in which motor grader 100 travels in straight lines is referred to as a fore/aft direction of motor grader 100. In the fore/aft direction of motor grader 100, a side where front wheel 11 is arranged with respect to work implement 4 is defined as the fore direction. In the fore/aft direction of motor grader 100, a side where rear wheel 12 is arranged with respect to work implement 4 is defined as the rear direction. A lateral direction or a side of motor grader 100 is a direction orthogonal to the fore/aft direction in a plan view. A right side and a left side in the lateral direction in facing front are defined as a right direction and a left direction, respectively. An upward/downward direction of motor grader 100 is a direction orthogonal to the plane defined by the fore/aft direction and the lateral direction. A side in the upward/downward direction where the ground is located is defined as a lower side and a side where the sky is located is defined as an upper side.

In the drawings below, the fore/aft direction is shown with an arrow X in the drawings, the lateral direction is shown with an arrow Y in the drawings, and the upward/downward direction is shown with an arrow Z in the drawings.

Rear frame 21 is arranged in the rear of front frame 22. Rear frame 21 supports an exterior cover 25 and components such as an engine arranged in engine compartment 6. Exterior cover 25 covers engine compartment 6. For example, rear wheels 12, two on each side, are attached to rear frame 21 as being rotatable by driving force from the engine.

Cab 3 is carried on rear frame 21. Cab 3 includes an indoor space which an operator enters and it is arranged at a front end of rear frame 21. Cab 3 may be carried on front frame 22.

In cab 3, an operation portion such as a steering wheel for steering front wheel 11, a gear shift lever, a lever for controlling work implement 4, a brake, and an accelerator pedal is provided. As an operator operates the steering wheel, an orientation of front wheel 11 is changed so that motor grader 100 can change a direction of travel. A steering angle of front wheel 11 is changed by an operation onto the steering wheel. A steering lever instead of the steering wheel may be provided to allow steering by a lever operation. Alternatively, both of the steering wheel and the steering lever can also be provided.

Front frame 22 is attached in front of rear frame 21. For example, front wheels 11, one on each side, are rotatably attached to a front end portion of front frame 22. A counterweight 51 is attached to the front end portion of front frame 22.

Work implement 4 mainly includes a draw bar 40, a swing circle 41, a blade 42, a slewing motor 49, and various cylinders 44 to 48.

Draw bar 40 has a front end portion swingably attached to a tip end portion of front frame 22. Draw bar 40 has a rear end portion supported on front frame 22 by a pair of lift cylinders 44 and 45. As a result of synchronous extending and retracting of the pair of lift cylinders 44 and 45, the rear end portion of draw bar 40 can move up and down with respect to front frame 22. Draw bar 40 is vertically swingable with an axis along a direction of travel of the vehicle being defined as the center, as a result of extending and retracting of lift cylinders 44 and 45 different from each other.

A draw bar shift cylinder 46 is attached to front frame 22 and a side end portion of draw bar 40. As a result of extending and retracting of draw bar shift cylinder 46, draw bar 40 is movable laterally with respect to front frame 22.

Swing circle 41 is revolvably attached to the rear end portion of draw bar 40. Swing circle 41 can be driven by slewing motor 49 as being revolvable clockwise or counterclockwise with respect to draw bar 40 when viewed from above the vehicle. As swing circle 41 is driven to revolve, an angle of inclination (which will also be referred to as a blade propulsive angle below) of blade 42 with respect to front frame 22 in the plan view is adjusted. In work implement 4 shown in FIG. 2, swing circle 41 is located at a position set by counterclockwise revolution in the plan view as compared with arrangement shown in FIG. 1. Therefore, blade 42 shown in FIG. 2 is arranged at a position different from blade 42 shown in FIG. 1.

Blade 42 is supported on swing circle 41. Blade 42 is supported on front frame 22 with swing circle 41 and draw bar 40 being interposed.

A blade shift cylinder 47 is attached to swing circle 41 and blade 42 and arranged along a longitudinal direction of blade 42. With blade shift cylinder 47, blade 42 is movable in the lateral direction with respect to swing circle 41.

A tilt cylinder 48 is attached to swing circle 41 and blade 42. As a result of extending and retracting of tilt cylinder 48, blade 42 swings around the axis extending in the longitudinal direction thereof with respect to swing circle 41, and can change its orientation in the up/down direction.

As set forth above, blade 42 is constructed to be able to move up and down with respect to the vehicle, swing around the axis along the direction of travel of the vehicle, change an angle of inclination with respect to the fore/aft direction, move in the lateral direction, and swing around the axis extending in the longitudinal direction thereof, with draw bar 40 and swing circle 41 being interposed.

Motor grader 100 further includes an acceleration sensor 9. In the present example, acceleration sensor 9 is attached to vehicular body 2. Acceleration sensor 9 is attached to front frame 22. Acceleration sensor 9 is attached to an upper surface of front frame 22.

Acceleration sensor 9 may be attached to a lower surface or a side surface of front frame 22. Alternatively, acceleration sensor 9 may be attached to the inside of front frame 22.

A main controller (FIG. 6) of motor grader 100 can obtain an acceleration on a horizontal plane (an X-Y plane) from acceleration sensor 9. The main controller can determine a direction of travel and a speed of vehicular body 2 (motor grader 100 and front frame 22) based on the obtained acceleration.

An inertial measurement apparatus may be used instead of acceleration sensor 9. The inertial measurement apparatus includes at least a gyro sensor and an acceleration sensor. The inertial measurement apparatus is also referred to as an inertial measurement unit (IMU), an inertial navigation unit (INU), an inertial guidance unit (IGU), or an inertial reference unit (IRU).

Figure 3:
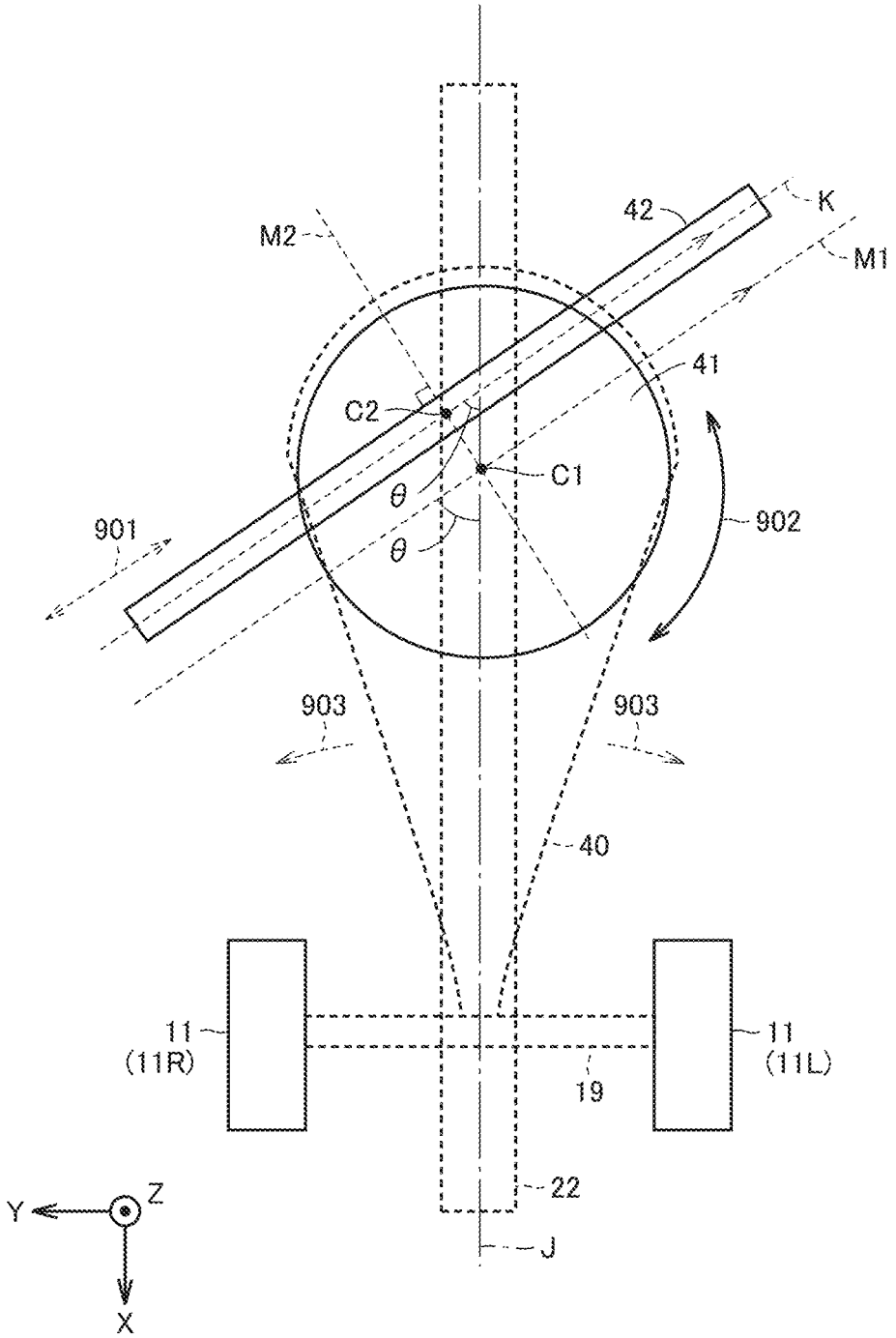
FIG. 3 is a diagram illustrating a blade propulsive angle.

FIG. 3 is a diagram for illustrating a blade propulsive angle.

As shown in FIG. 3, draw bar 40 moves in a direction shown with an arrow 903. Swing circle 41 rotates in a direction shown with an arrow 902. Blade 42 moves in a direction shown with an arrow 901. Blade 42 rotates around a rotation axis C1 by swing circle 41 being driven to revolve. As blade 42 rotates around rotation axis C1, a blade propulsive angle θ is varied.

A first virtual line M1 is a line orthogonal to rotation axis C1 and in parallel to blade 42 (a centerline K of blade 42). A second virtual line M2 is a line orthogonal to rotation axis C1 and orthogonal to first virtual line M1. First virtual line M1 and second virtual line M2 are lines in parallel to the XY plane.

Blade propulsive angle θ is an angle formed between front frame 22 and blade 42. Blade propulsive angle θ is an angle formed between an axial line J of front frame 22 and centerline K of blade 42. Blade propulsive angle θ is an angle formed between axial line J of front frame 22 and first virtual line M1. Blade propulsive angle θ is an angle of inclination of blade 42 with respect to the longitudinal direction of front frame 22.

In the present example, blade propulsive angle θ in a state in FIG. 3 is defined as having a positive value. Blade propulsive angle θ at the time when a right end of blade 42 is located on a side of the front wheel relative to a left end while draw bar 40 is located at a neutral position as in FIG. 3 is defined as having the positive value. Blade propulsive angle θ at the time when the left end of blade 42 is located on the side of the front wheel relative to the right end is defined as having a negative value.

An absolute value of blade propulsive angle θ is normally set within a range from 45° to 60°. The range of the absolute value of blade propulsive angle θ is not smaller than 0° and not larger than 90°.

Figure 4:
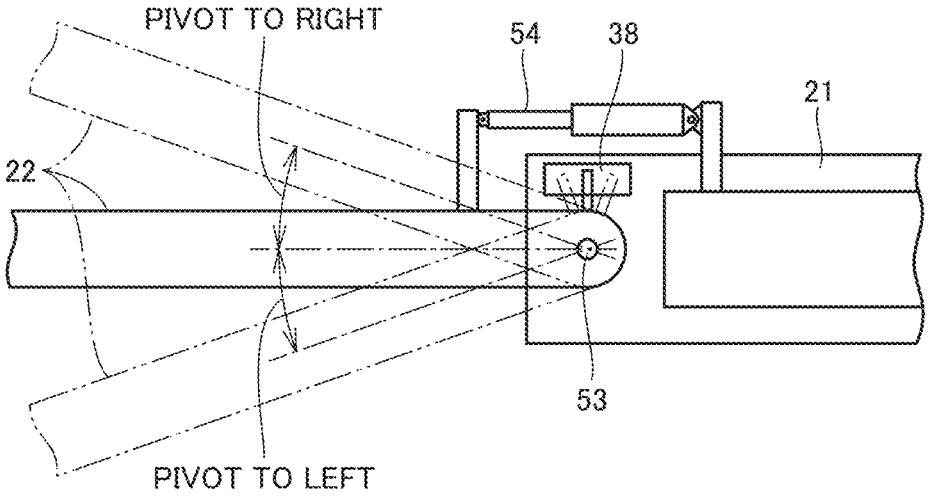
FIG. 4 is a diagram illustrating overview of a construction of a pivot mechanism.

Motor grader 100 can perform an articulation operation for pivoting front frame 22 with respect to rear frame 21. Motor grader 100 includes a pivot mechanism for performing the articulation operation. FIG. 4 is a diagram illustrating overview of a construction of the pivot mechanism.

As shown in FIG. 4, front frame 22 and rear frame 21 are coupled to each other by a coupling shaft 53. Coupling shaft 53 extends in the upward/downward direction (a direction perpendicular to the sheet plane in FIG. 4). Coupling shaft 53 is arranged at a position substantially below cab 3 (not shown in FIG. 4).

Coupling shaft 53 couples front frame 22 to rear frame 21 as being pivotable with respect to rear frame 21. Front frame 22 is revolvable in two directions with respect to rear frame 21 with coupling shaft 53 being defined as the center. An angle formed by front frame 22 with respect to rear frame 21 is adjustable.

Front frame 22 pivots with respect to rear frame 21 as a result of extending and retracting of an articulation cylinder 54 coupled between front frame 22 and rear frame 21 based on an operation from cab 3. An angle sensor 38 is attached to rear frame 21, and the angle sensor detects an angle of articulation representing an angle of pivot of front frame 22 with respect to rear frame 21.

By pivoting (articulating) front frame 22 with respect to rear frame 21, a slewing radius in revolution of motor grader 100 can be made smaller and a ditch digging work or a grading work by offset running can be done. Offset running refers to linear travel of motor grader 100 by setting a direction of pivot of front frame 22 with respect to rear frame 21 and a direction of revolution of front wheel 11 with respect to front frame 22 to directions opposite to each other.

Figure 5:
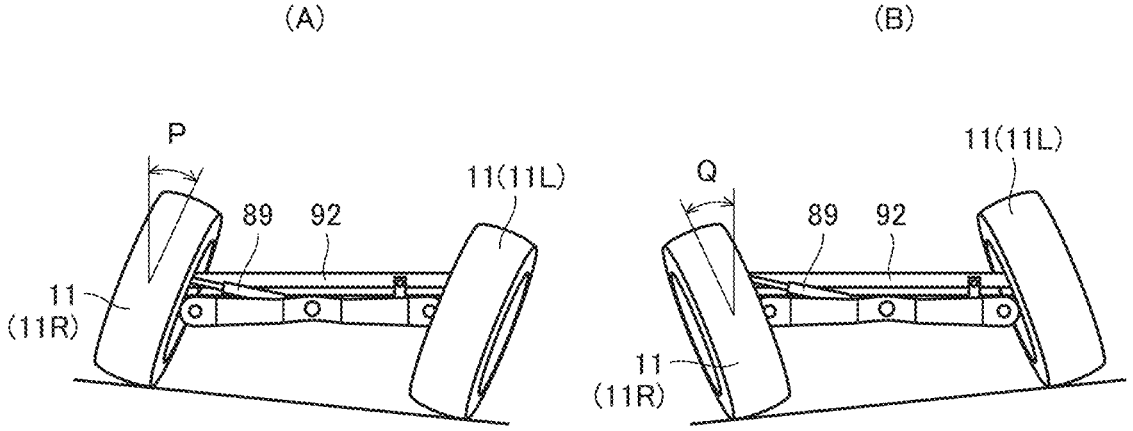
FIG. 5 is a conceptual diagram illustrating a leaning operation of the motor grader.

FIG. 5 is a conceptual diagram illustrating a leaning operation of motor grader 100.

FIG. 5 (A) shows a state of front wheel 11 in a left leaning operation. An example in which front wheel 11 is inclined to the left by an angle P with extending and retracting of a leaning cylinder 92 is shown. Accordingly, a slewing radius in revolution to the left becomes smaller.

FIG. 5 (B) shows a state of front wheel 11 in a right leaning operation. An example in which front wheel 11 is inclined to the right by an angle Q with extending and retracting of leaning cylinder 92 is shown. Accordingly, a slewing radius in revolution to the right becomes smaller.

Figure 6:
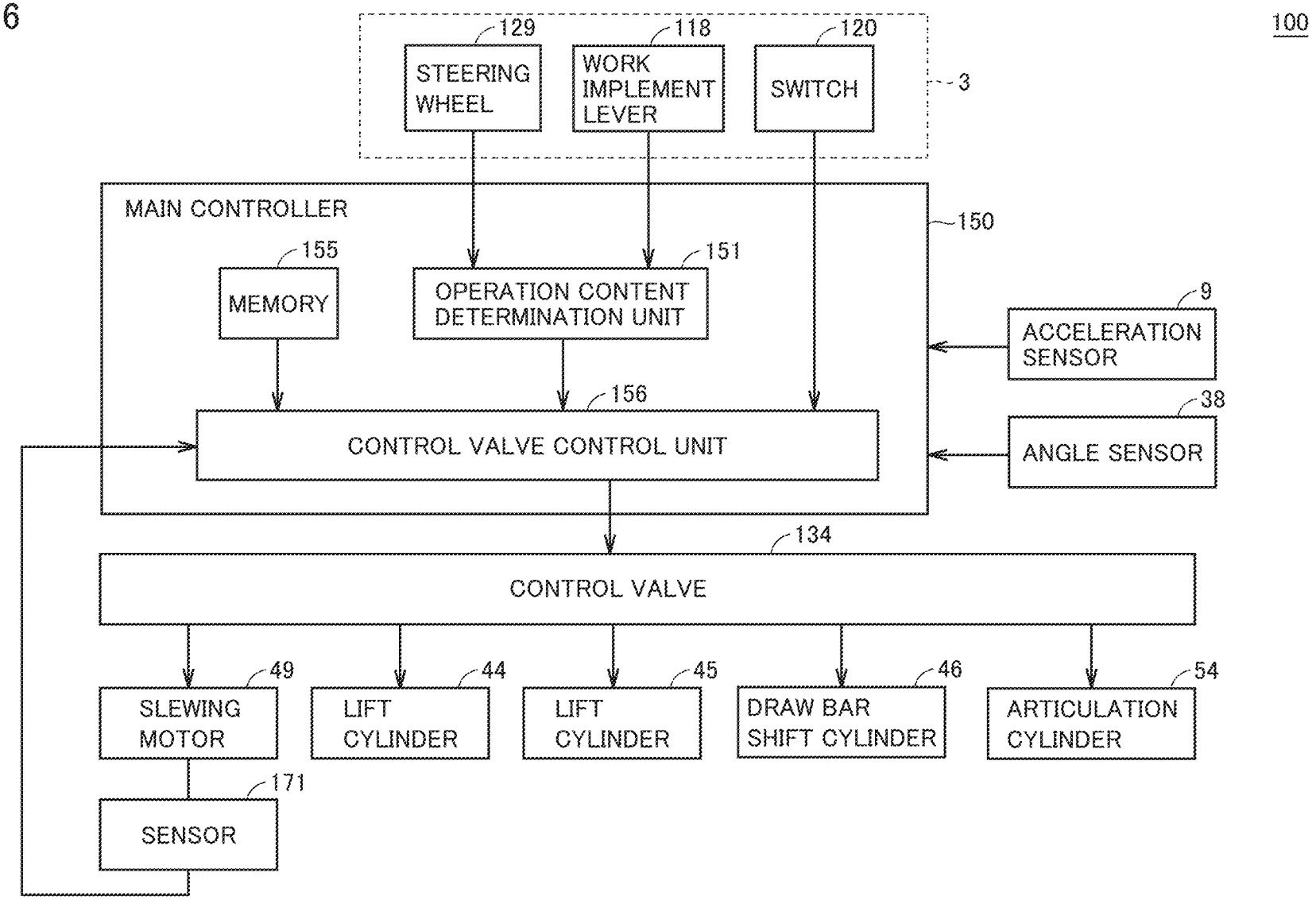
FIG. 6 is a functional block diagram illustrating a functional configuration of a control system of the motor grader.

FIG. 6 is a functional block diagram illustrating a functional configuration of a control system of motor grader 100.

FIG. 6 shows relation between a main controller 150 and other peripheral devices. Acceleration sensor 9, angle sensor 38, a work implement lever 118, a switch 120, a steering wheel 129 for steering front wheel 11, a sensor 171, slewing motor 49, lift cylinders 44 and 45, draw bar shift cylinder 46, and articulation cylinder 54 are shown as the peripheral devices.

Work implement lever 118, switch 120, and steering wheel 129 are provided in cab 3.

Main controller 150 is a controller that controls the entire motor grader 100. Main controller 150 is implemented by a central processing unit (CPU), a non-volatile memory where a program is stored, and the like.

Main controller 150 controls a control valve 134 and the like. Work implement lever 118, switch 120, and steering wheel 129 are connected to main controller 150. Main controller 150 provides a lever operation signal (an electrical signal) in accordance with an operated state of work implement lever 118 to control valve 134.

Control valve 134 is an electromagnetic proportional valve. Control valve 134 is connected to main controller 150. Main controller 150 provides an operation signal (electrical signal) in accordance with a direction of operation and/or an amount of operation onto work implement lever 118 to control valve 134. Control valve 134 controls an amount of hydraulic oil to be supplied from a hydraulic pump (not shown) to a hydraulic actuator in accordance with the operation signal. Exemplary hydraulic actuators include slewing motor 49, lift cylinders 44 and 45, draw bar shift cylinder 46, blade shift cylinder 47, and tilt cylinder 48.

Main controller 150 includes an operation content determination unit 151, a memory 155, and a control valve control unit 156.

Sensor 171 detects an angle of rotation (blade propulsive angle θ) of swing circle 41. Sensor 171 transmits information on the angle of rotation to control valve control unit 156.

Operation content determination unit 151 determines contents of an operation onto work implement lever 118 by an operator. Operation content determination unit 151 provides a result of determination to control valve control unit 156.

Various types of information are stored in memory 155.

Control valve control unit 156 controls drive of slewing motor 49 by controlling control valve 134 in accordance with magnitude of a current value which is an operation command to be provided. Control valve control unit 156 receives information on a circle rotation angle from sensor 171. Control valve control unit 156 corrects a current value which is an operation command to control valve 134 based on the information on the circle rotation angle from sensor 171.

Acceleration sensor 9 sends a result of measurement to main controller 150. Acceleration sensor 9 notifies main controller 150 of the acceleration.

Switch 120 is a switch for having blade propulsive angle θ automatically follow change in direction of travel of motor grader 100. As the operator turns on switch 120, automatic control of blade propulsive angle θ using an output from acceleration sensor 9 is started. As the operator turns off switch 120, automatic control of blade propulsive angle θ is stopped.

For example, an alternate switch can be employed as switch 120. A control lever may be provided instead of switch 120. A specific construction of an operation apparatus for automatic control of blade propulsive angle θ is not particularly limited.

Figure 7:
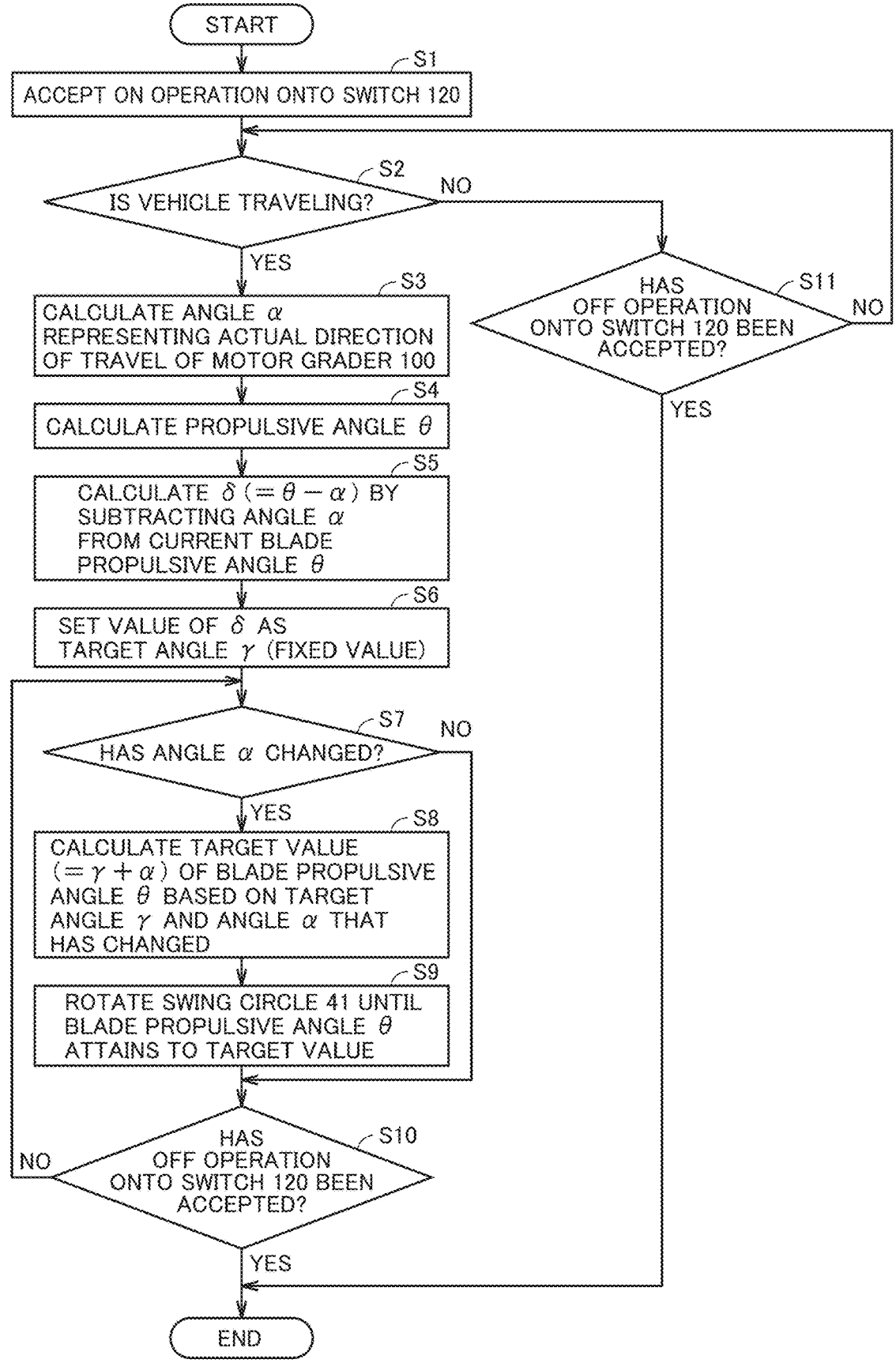
FIG. 7 is a flowchart for illustrating a flow of processing performed in the motor grader.

FIG. 7 is a flowchart for illustrating a flow of processing performed in motor grader 100.

Referring to FIG. 7, in step S1, motor grader 100 accepts an on operation onto switch 120. In this case, switch 120 transmits a signal based on the on operation to main controller 150.

In step S2, main controller 150 determines whether or not motor grader 100 is traveling. For example, main controller 150 determines whether or not motor grader 100 is traveling forward.

When main controller 150 determines that the motor grader is not traveling (NO in step S2), in step S11, main controller 150 determines whether or not it has accepted an off operation onto switch 120. When the main controller determines that it has accepted the off operation (YES in step S11), a series of processing ends. When main controller 150 determines that it has not accepted the off operation (NO in step S11), the process returns to step S2.

When main controller 150 determines that the motor grader is traveling (YES in step S2), in step S3, main controller 150 calculates an angle α representing an actual direction of travel of motor grader 100 based on an output from acceleration sensor 9.

In step S4, main controller 150 calculates blade propulsive angle θ of blade 42 based on an output from sensor 171. In step S5, main controller 150 calculates an angle δ(=θ−α) formed by blade 42 with respect to the actual direction of travel by subtracting angle α calculated in step S3 from blade propulsive angle θ calculated in step S4. In step S6, main controller 150 has a value of angle δ temporarily stored in memory 155 as a target angle γ (fixed value).

In step S7, main controller 150 determines whether or not angle α has changed based on an output from acceleration sensor 9. When main controller 150 determines that angle α has not changed (NO in step S7), the process proceeds to step S10.

When main controller 150 determines that angle α has changed (YES in step S7), in step S8, main controller 150 calculates a target value of blade propulsive angle θ based on target angle γ and angle α that has changed. Main controller 150 calculates the target value (=γ+α) of blade propulsive angle θ by adding angle α to target angle γ. In step S9, main controller 150 has swing circle 41 rotate until blade propulsive angle θ attains to the target value.

In step S10, main controller 150 determines whether or not it has accepted the off operation onto switch 120. When the main controller determines that the off operation has been accepted (YES in step S10), the series of processing ends. When main controller 150 determines that it has not accepted the off operation (NO in step S10), the process returns to step S7.

A cycle of calculation of angle α in step S7 is set as appropriate by main controller 150. By shortening the cycle, followability can be enhanced.

Figure 8:
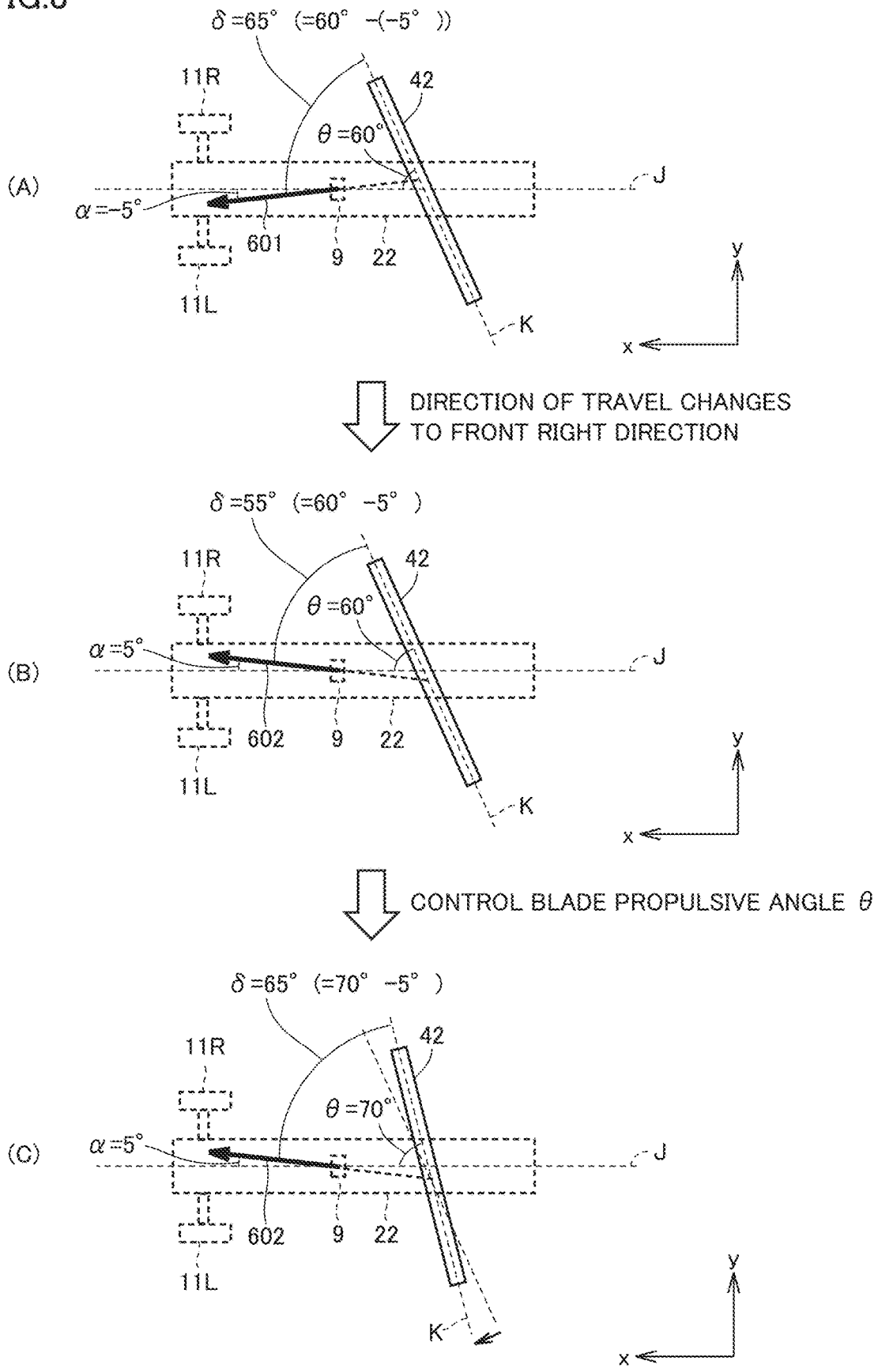
FIG. 8 is a diagram for illustrating overview of automatic control of a blade propulsive angle.

FIG. 8 is a diagram for illustrating overview of automatic control of blade propulsive angle θ. Blade propulsive angle θ is automatically controlled based on an output from acceleration sensor 9. An xy coordinate system used in the description below is a coordinate system with a position of acceleration sensor 9 being defined as the reference, and it represents a state at the time when an x axis is in parallel to axial line J of front frame 22.

A state (A) represents a state at the time when a steering angle is set to 0° whereas the actual direction of travel of motor grader 100 is a forward left direction. The state (A) represents a state at the time when blade propulsive angle θ (an angle formed between axial line J and blade 42) is set to 60°. In this case, based on an output from acceleration sensor 9, angle α representing the actual direction of travel (a direction shown with an arrow 601) of motor grader 100 is −5°. One of reasons why angle α is not 0° is variation in coefficient of kinetic friction of wheels 11 and 12 of motor grader 100 depending on a condition of the road surface.

Angle α representing the actual direction of travel is −5°. Therefore, even when blade propulsive angle θ (the angle formed between axial line J and blade 42) is 60°, an angle δ (angle δ formed between the X axis and blade 42 (0≤δ≤180)) of blade 42 with respect to the actual direction of travel is 65° (=60°−(−5°)).

In this aspect, angle α is defined as an angle formed between the x axis and the actual direction of travel of motor grader 100. Whether angle α is positive or negative is defined such that angle α has a negative value when the actual direction of travel of motor grader 100 has a component in a negative direction along a y axis. Such definition, however, is by way of example, and limitation as such is not intended.

It is assumed that, in the state (A), the operator turns on prescribed switch 120 (see FIG. 6) for automatic control of blade propulsive angle θ and thereafter the direction of travel (actual direction of travel) of motor grader 100 changes to a forward right direction (a state (B)).

In this case, based on the output from acceleration sensor 9, angle α representing the actual direction of travel (a direction shown with an arrow 602) of motor grader 100 is 5° as shown in the state (B). The steering angle is set to 0° also in the state (B).

Since the actual direction of travel has changed, motor grader 100 changes blade propulsive angle θ. Motor grader 100 changes blade propulsive angle θ in order to follow change in actual direction of travel.

Specifically, motor grader 100 controls blade propulsive angle θ to satisfy an expression (1) below.

$$\theta=\gamma+\alpha \tag{1}$$

Target angle γ represents an angle (fixed value) calculated by subtracting a from θ at the time when prescribed switch 120 described above is turned on. In the present example, in the example in the state (A), γ has a value calculated by subtracting −5° from 60°. Specifically, in the example in the state (A), γ is 65°.

In the state (B), angle α has changed from −5° to 5°. Therefore, motor grader 100 changes blade propulsive angle θ from 60° to 70° as shown in a state (C), by referring to the expression (1). Since angle α has increased by 10°, motor grader 100 increases also blade propulsive angle θ by 10°. Through such processing, an inclination of blade 42 with respect to the X axis or the Y axis is the same between the state (A) and the state (C).

Specifically, angle α representing the actual direction of travel is 5°. Therefore, even when blade propulsive angle θ (angle formed between axial line J and blade 42) is 70°, angle δ formed by blade 42 with respect to the actual direction of travel is 65° (=70°−5°) as in the state (A).

As set forth above, motor grader 100 controls blade propulsive angle θ of blade 42 based on the output from acceleration sensor 9 placed in vehicular body 2. Motor grader 100 changes blade propulsive angle θ in accordance with an amount of change in angle in the direction of travel of motor grader 100. Motor grader 100 changes blade propulsive angle θ by an amount equal to the amount of change in angle in the direction of travel of motor grader 100.

According to such a configuration, motor grader 100 (specifically, the main controller) can determine the actual direction of travel of motor grader 100. Therefore, motor grader 100 can have blade propulsive angle θ accurately follow change in direction of travel of motor grader 100.

In the example in FIG. 8, processing at the time when the direction of travel (actual direction of travel) of motor grader 100 changes after switch 120 is turned on while the steering angle is set to 0° and an advantage obtained by the processing are described. Such an advantage is obtained also when the steering wheel is further turned after switch 120 is turned on while the steering wheel is in a state other than a neutral state. In addition, the advantage is obtained also when the steering wheel is maintained at the neutral position after switch 120 is turned on while the steering wheel is in the neutral state. Thus, when the actual direction of travel changes after turn-on of switch 120, motor grader 100 performs processing for automatically controlling blade propulsive angle θ.

Motor grader 100 is configured to determine the direction of travel with acceleration sensor 9 placed in front frame 22. Therefore, even when motor grader 100 is doing works while it is articulated, it can have blade propulsive angle θ accurately follow change in direction of travel of motor grader 100. Furthermore, even when motor grader 100 is doing works while the front wheels are leaning, motor grader 100 can have blade propulsive angle θ accurately follow change in direction of travel of motor grader 100.

By thus attaching acceleration sensor 9 to front frame 22, regardless of an attitude of motor grader 100, blade propulsive angle θ can accurately follow change in direction of travel of motor grader 100.

Modification

Figure 9:
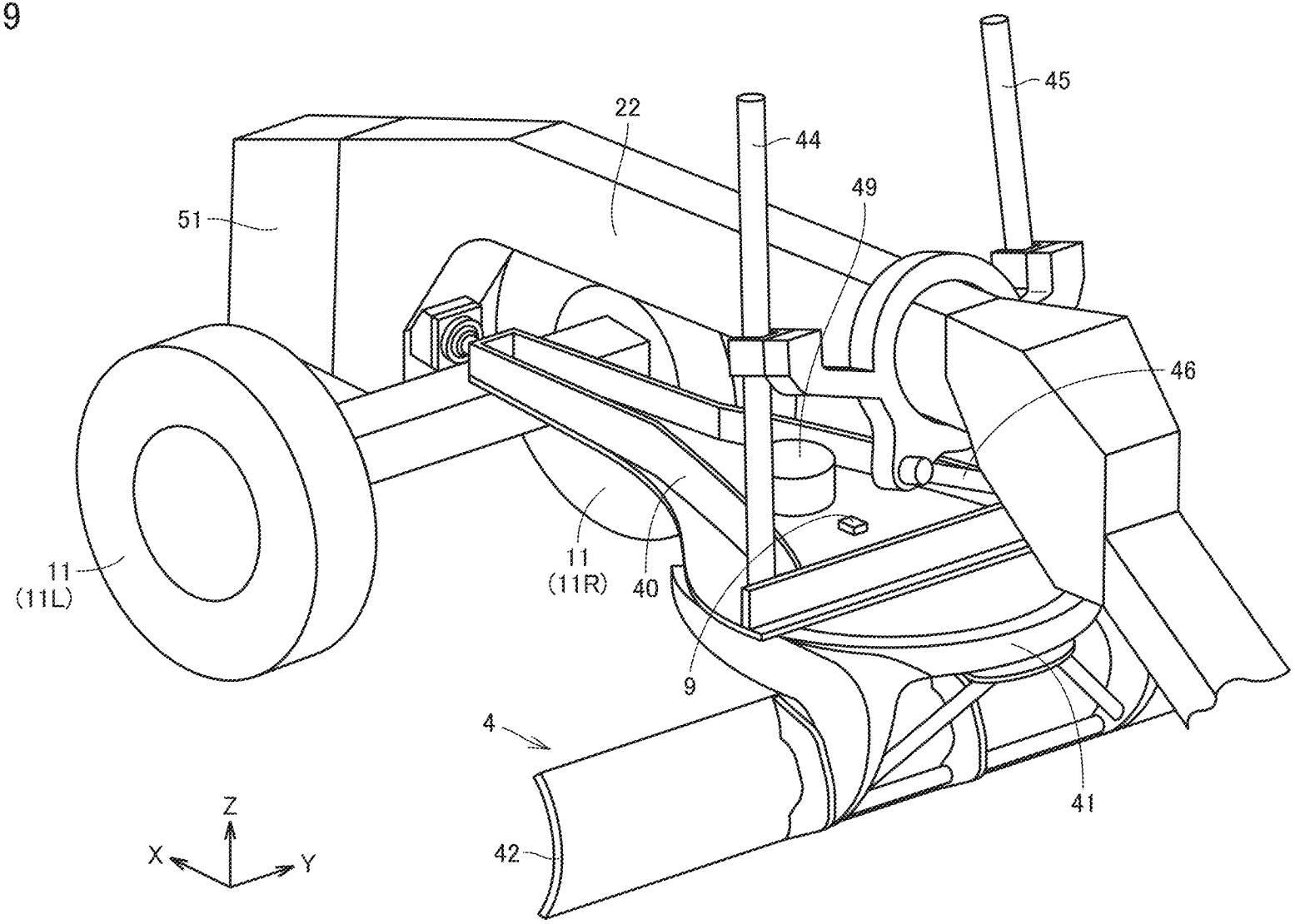
FIG. 9 is a diagram for illustrating another position of placement of an acceleration sensor.

FIG. 9 is a diagram for illustrating another position of placement of acceleration sensor 9.

Referring to FIG. 9, acceleration sensor 9 is attached to draw bar 40. Acceleration sensor 9 is attached to a surface of draw bar 40 so as to be located directly under front frame 22 in a state in which draw bar 40 is at the neutral position (the state in FIG. 2). Acceleration sensor 9 is attached in the rear of slewing motor 49.

Acceleration sensor 9 may be attached in front of slewing motor 49. Acceleration sensor 9 may be attached to any portion of draw bar 40.

Second Embodiment

A configuration in an example in which automatic control of the blade propulsive angle described in the first embodiment is applied to a crawler dozer will be described in the present embodiment. Description of a redundant configuration as in the first embodiment will not be repeated below.

Figure 10:
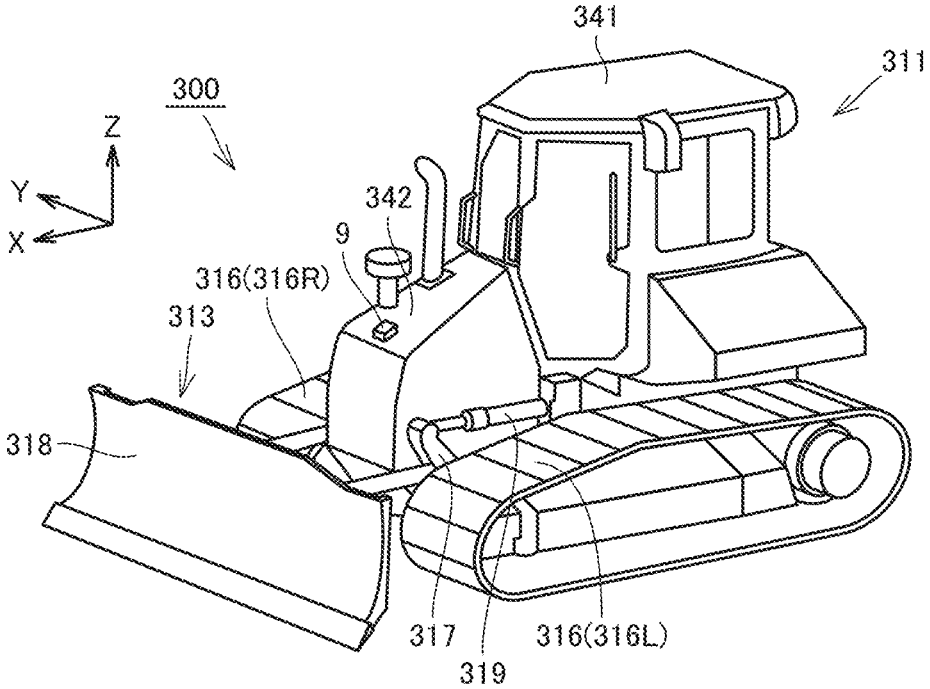
FIG. 10 is a perspective view showing a crawler dozer.

FIG. 10 is a perspective view showing a crawler dozer.

As shown in FIG. 10, a crawler dozer 300 includes a vehicular body 311 and a work implement 313. Vehicular body 311 includes a pair of left and right tow apparatuses 316 (316R and 316L), a cab 341, and an engine compartment 342. Work implement 313 is provided in front of vehicular body 311. Work implement 313 includes a blade 318 for doing such works as excavation of soil and land grading.

The pair of left and right tow apparatuses 316 (316R and 316L) is an apparatus for travel of crawler dozer 300. The pair of left and right tow apparatuses 316 (316R and 316L) includes, for example, a crawler belt and a final reduction gear. As the pair of left and right tow apparatuses 316 (316R and 316L) is rotationally driven, crawler dozer 300 travels.

Acceleration sensor 9 is attached to vehicular body 311. Acceleration sensor 9 is attached to a surface of engine compartment 342. Acceleration sensor 9 may be placed in cab 341.

Figure 11:
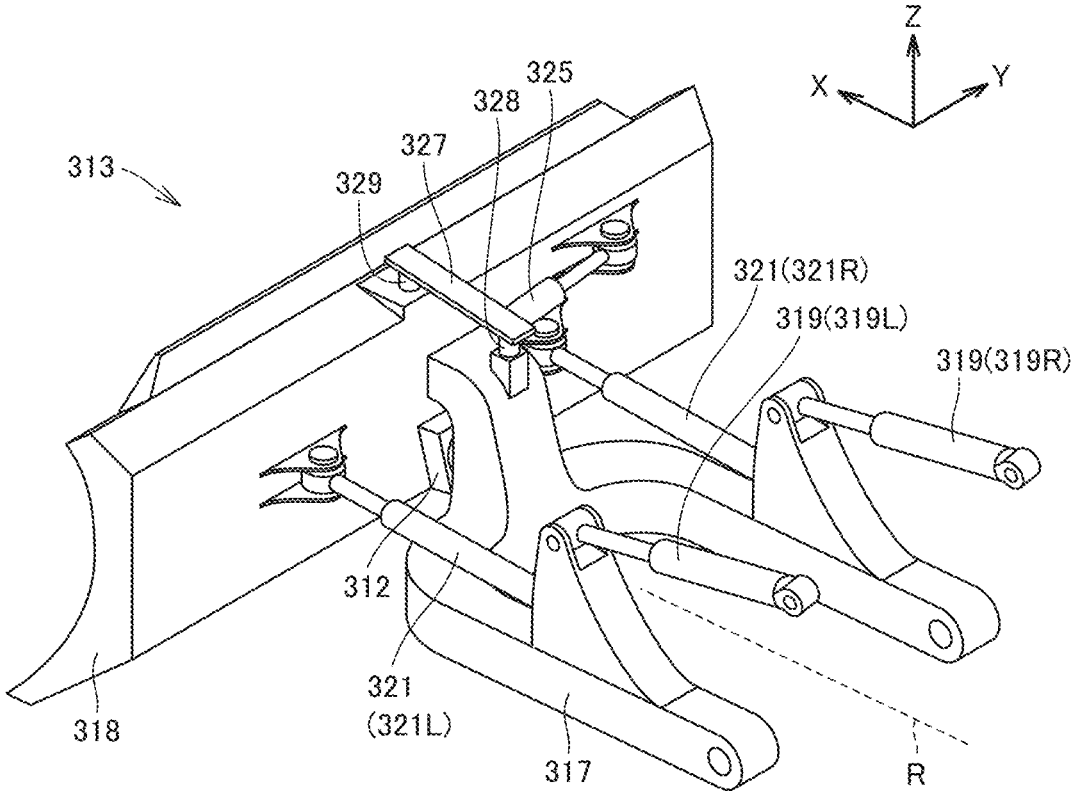
FIG. 11 is an enlarged view of a main part of the crawler dozer.

FIG. 11 is an enlarged view of a main part of crawler dozer 300.

As shown in FIG. 11, crawler dozer 300 further includes a ball joint 312, a frame 317 in a U shape, a pair of lift cylinders 319 (319R and 319L), a pair of angle cylinders 321 (321R and 321L), a tilt cylinder 325, and a pitch rod 327. The pair of lift cylinders 319 (319R and 319L) and the pair of angle cylinders 321 (321R and 321L) are each arranged at positions in symmetry with respect to an axial line R of frame 317.

Ball joint 312 rotatably connects blade 318 and U frame 317 to each other.

Pitch rod 327 can adjust a pitch of blade 318. Pitch rod 327 has one end connected to blade 318 with a coupling member 329 being interposed and has the other end connected to frame 317 with a coupling member 328 being interposed.

Crawler dozer 300 moves up or down blade 318 by changing a stroke length of lift cylinder 319 (319R and 319L). Crawler dozer 300 changes blade propulsive angle θ of blade 318 by changing the stroke length of angle cylinder 321 (321R and 321L).

Figure 12:
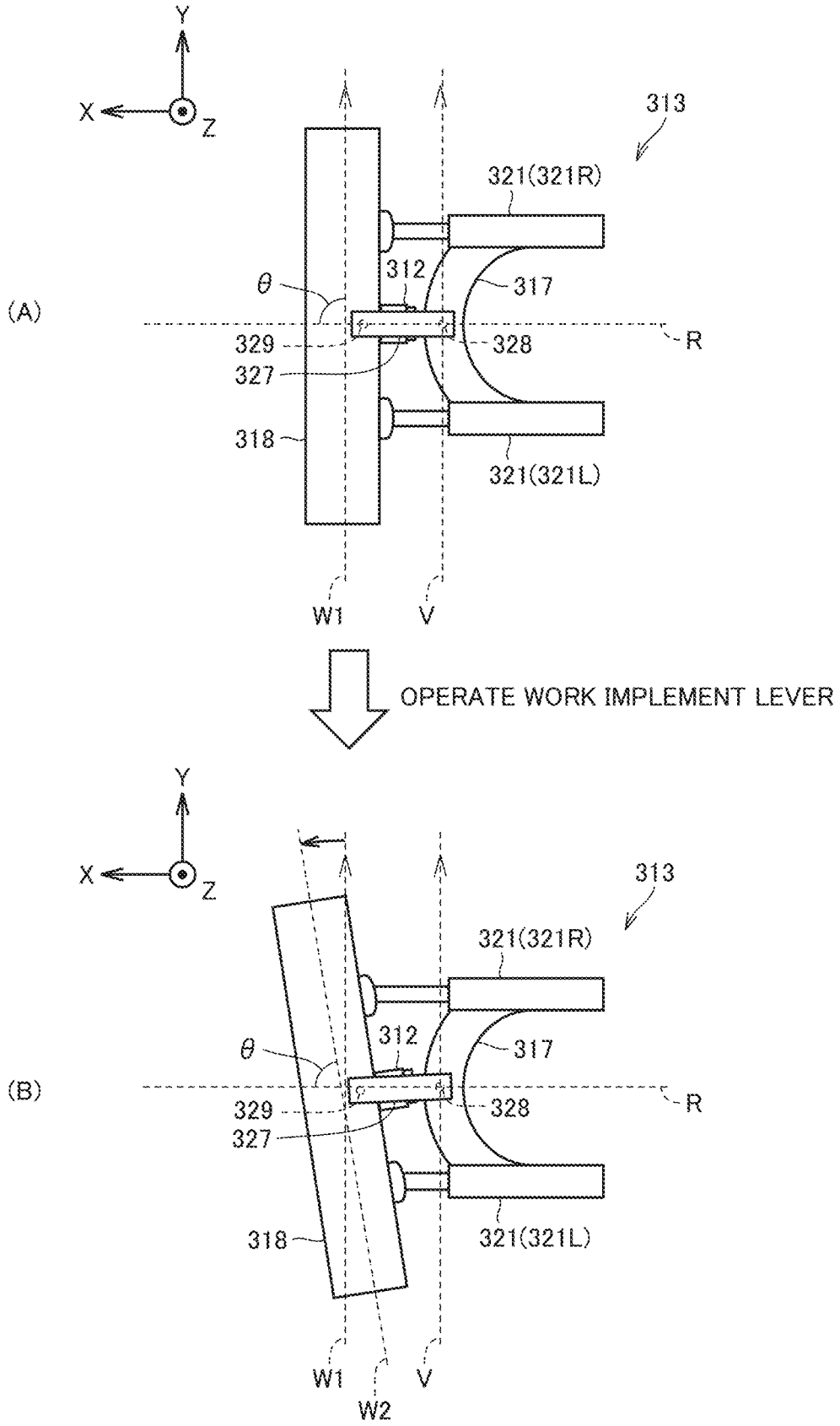
FIG. 12 is a diagram for illustrating a blade propulsive angle in the crawler dozer.

FIG. 12 is a diagram for illustrating blade propulsive angle θ in crawler dozer 300.

Referring to FIG. 12, the state (A) represents a state in which blade propulsive angle θ is set to 90°. In the state (A), a virtual line V that passes through coupling member 328 and is in parallel to the Y axis and an axial line W1 of blade 318 are in parallel to each other.

As the operator operates a control lever for angle cylinder 321 (321R and 321L) in the state (A), blade propulsive angle θ changes. In this case, an angle formed on the XY plane between axial line R of frame 317 and an axial line W2 of blade 318 after the change is defined as blade propulsive angle θ.

Thus, also in crawler dozer 300, works are done with blade propulsive angle θ being set by the operator. Therefore, automatic control of the blade propulsive angle described in the first embodiment can be applied to crawler dozer 300.

Therefore, crawler dozer 300 (specifically, a controller (not shown) of crawler dozer 300) can determine the actual direction of travel of crawler dozer 300. Accordingly, crawler dozer 300 can have blade propulsive angle θ accurately follow change in direction of travel of crawler dozer 300.

It should be understood that the embodiments disclosed herein are illustrative and non-restrictive in every respect. The scope of the present invention is defined by the terms of the claims rather than the description above and is intended to include any modifications within the scope and meaning equivalent to the terms of the claims.

REFERENCE SIGNS LIST

2, 311 vehicular body; 3 cab; 4, 313 work implement; 6, 342 engine compartment; 9 acceleration sensor; 11 front wheel; 12 rear wheel; 21 rear frame; 22 front frame; 25 exterior cover; 38 angle sensor; 40 draw bar; 41 swing circle; 42, 318 blade; 44, 45, 319 lift cylinder; 46 draw bar shift cylinder; 47 blade shift cylinder; 48, 325 tilt cylinder; 49 slewing motor; 51 counterweight; 53 coupling shaft; 54 articulation cylinder; 92 leaning cylinder; 100 motor grader; 120 switch; 129 steering wheel; 139 throttle dial; 145 potentiometer; 146 starter switch; 150 main controller; 151 operation content determination unit; 155 memory; 156 control valve control unit; 171 sensor; 300 crawler dozer; 312 ball joint; 316 tow apparatus; 317 frame; 321 angle cylinder; 327 pitch rod; 328, 329 coupling member; 341 cab; C1 rotation axis; J, R, W1, W2 axial line; K centerline; M1 first virtual line; M2 second virtual line; V virtual line

The invention claimed is:

1. A work vehicle comprising:

a vehicular body; and a work implement including a blade, wherein the vehicular body includes a controller that controls an operation of the work implement and an acceleration sensor, and the controller obtains an acceleration on a horizontal plane from the acceleration sensor, determines a direction of travel of the work vehicle, and changes a blade propulsive angle of the blade by an amount equal to an amount of change in angle in the direction of travel based on the obtained acceleration from the acceleration sensor.

2. The work vehicle according to claim 1, wherein the vehicular body further includes an operation apparatus, and the controller controls the blade propulsive angle based on the output from the acceleration sensor on condition that the operation apparatus has been operated.

3. The work vehicle according to claim 1, wherein the work vehicle is a motor grader, the vehicular body further includes a rear frame and a front frame pivotable with respect to the rear frame, and the acceleration sensor is provided in the front frame.

4. The work vehicle according to claim 1, wherein the work implement includes a swing circle on which the blade is supported and an actuator that rotates the swing circle, and the controller controls the blade propulsive angle by causing the actuator to operate.

5. The work vehicle according to claim 1, wherein the work vehicle is a crawler dozer, the work implement further includes a blade propulsive angle cylinder, and the controller controls the blade propulsive angle by causing the blade propulsive angle cylinder to operate.

6. The work vehicle according to claim 1, wherein the vehicular body further includes a cab, and the acceleration sensor is provided in the cab.

7. A work vehicle comprising:

a swing circle;

a blade supported on the swing circle;

a front frame;

a draw bar attached to the front frame to fluctuate, the swing circle being attached to the draw bar;

an acceleration sensor provided in the draw bar; and a controller that obtains an acceleration on a horizontal plane from the acceleration sensor, determines a direction of travel of the work vehicle, and changes a blade propulsive angle of the blade by an amount equal to an amount of change in angle in the direction of travel by causing the swing circle to rotate based the obtained acceleration from the acceleration sensor.

8. A method of controlling a work vehicle, the work vehicle including a vehicular body and a work implement including a blade, the vehicular body including a controller that controls an operation of the work implement and an acceleration sensor, the method comprising:

receiving, by the controller, a signal provided from the acceleration sensor;

obtaining, by the controller, an acceleration on a horizontal plane based on the signal from the acceleration sensor; and determining, by the controller, a direction of travel of the work vehicle and changing a blade propulsive angle of the blade by an amount equal to an amount of change in angle in the direction of travel based on the obtained acceleration from the acceleration sensor.

9. The method according to claim 8, wherein in the controlling a blade propulsive angle, the blade propulsive angle is controlled based on an output from the acceleration sensor on condition that an operation apparatus provided in the vehicular body has been operated.

10. The method according to claim 8, wherein the work vehicle is a motor grader, the vehicular body further includes a rear frame and a front frame pivotable with respect to the rear frame, and the acceleration sensor is provided in the front frame.

11. The method according to claim 8, wherein the work implement includes a swing circle on which the blade is supported and an actuator that rotates the swing circle, and in the controlling a blade propulsive angle, the controller controls the blade propulsive angle by causing the actuator to operate.

12. The method according to claim 8, wherein the work vehicle is a crawler dozer and the work implement further includes a blade propulsive angle cylinder, and in the controlling a blade propulsive angle, the controller controls the blade propulsive angle by causing the blade propulsive angle cylinder to operate.

13. The method according to claim 8, wherein the vehicular body further includes a cab, and the acceleration sensor is provided in the cab.

14. A method of controlling a work vehicle, the work vehicle including a swing circle, a blade supported on the swing circle, a front frame, a draw bar attached to the front frame to fluctuate, the swing circle being attached to the draw bar, an acceleration sensor provided in the draw bar, and a controller, the method comprising:

receiving, by the controller, a signal provided from the acceleration sensor;

obtaining, by the controller, an acceleration on a horizontal plane based on the signal from the acceleration sensor; and determining by the controller, a direction of travel of the work vehicle and changing a blade propulsive angle of the blade by an amount equal to an amount of change in angle in the direction of travel by causing the swing circle to rotate based on the obtained acceleration from the acceleration sensor.

* * * * *